US005282449A

United States Patent [19]

Takahashi et al.

[11] Patent Number: 5,282,449

[45] Date of Patent: Feb. 1, 1994

[54] METHOD AND SYSTEM FOR ENGINE CONTROL

[75] Inventors: Shinsuke Takahashi, Yokohama; Teruji Sekozawa, Kawasaki; Makoto Shioya, Suginami, all of Japan

[73] Assignee: Hitachi, Ltd., Tokyo, Japan

[21] Appl. No.: 846,960

[22] Filed: Mar. 6, 1992

[30] Foreign Application Priority Data

Mar. 6, 1991 [JP] Japan ..... 3-039838

[51] Int. Cl.[5] ..... F02D 41/14

[52] U.S. Cl. ..... 123/350; 123/480

[58] Field of Search ..... 123/350, 399, 480, 478

[56] References Cited

U.S. PATENT DOCUMENTS

| | | | |
|---|---|---|---|
| 4,811,713 | 3/1989 | Shimada et al. | 123/399 |
| 4,953,530 | 9/1990 | Manaka et al. | 123/399 |
| 5,078,109 | 1/1992 | Yoshida et al. | 123/350 |
| 5,095,874 | 3/1992 | Schnaibel et al. | 123/478 |

FOREIGN PATENT DOCUMENTS 60-175742 9/1985 Japan .

*Primary Examiner*—Andrew M. Dolinar

*Attorney, Agent, or Firm*—Antonelli, Terry, Stout & Kraus

[57] ABSTRACT

To ensure a high-precision simultaneous control of the enginegenerated torque, air fuel ratio of the automobile engine and related factor, the present invention calculates the target air mass flow rate as the air mass flow rate at the inlet port which achieves the target torque, estimates the air flow condition inside the intake manifold, supplies the result to the fuel injection control system and the throttle control system, and determines the fuel injection pulse width which achieves the target air fuel ratio according to the estimated air mass flow rate at the inlet port for the fuel injection control system, while determining the throttle angle which achieves the target torque according to the estimated condition and the target air mass flow rate for the throttle control system.

28 Claims, 12 Drawing Sheets

METHOD AND SYSTEM FOR ENGINE CONTROL

BACKGROUND OF THE INVENTION

1. Field of the Invention

The present invention is related to the method and system for simultaneous control of the throttle valve and fuel injection to ensure that the torque and air fuel ratio of the automobile engine will reach target values.

2. DESCRIPTION OF THE PRIOR ART

A method to control the throttle valve and fuel injection to ensure that both torque and air fuel ratio of the automobile engine will reach target values is described in the Japanese Patent Application Laid-open NO.60-175742. According to this method, the angle through which the throttle is moved $\Delta\theta$ is calculated by searching a prearranged table on the basis of the difference (Z-T) between the target torque Z calculated using the proper torque function and actual torque T. Or angle through which the throttle is moved amount $\Delta\theta$ is calculated by PID control according to the said difference. Furthermore, the throttle valve actuator is supplied with a drive signal which changes the throttle angle by a calculated throttle angle angle $\Delta\theta$.

All prior methods utilize feedback control to allow the target value to reach the actual value. When feedback control is used, overshooting tends to occur in the controlled variable when an attempt is made to improve the control response, whereas the tracking performance of the controlled variable to the target value deteriorates when an attempt is made to stabilize the system to eliminate the possibility of overshooting. In either case, the torque which is a controlled variable cannot be controlled to the target value with a high precision. Namely, such prior methods are accompanied by the problem that the engine generated torque cannot be maintained at a proper value within a variety of operating ranges. Another problem is that, since said methods also use a torque sensor, the cost is increased by the price of the sensor.

SUMMARY OF THE INVENTION

An object of the present invention is to provide a method and system for engine control which is capable of solving all said problems; and, it is a further object to provide a method and system for engine control which ensure a high precision control of the torque to reach a target value, without using a torque sensor.

The present invention provided to achieve said object is characterized by the use of a high-precision status estimating model which permits high-precision estimation of the air flow status inside the intake manifold; it is also characterized by the use of the throttle valve, which is feedforward-controlled in such a manner that the air mass flow rate at the inlet port as a major factor for torque generation will reach a torque required to achieve the, target value.

To be more specific, in accordance with the present invention, the operating conditions of the engine dependent on the air mass flow rate are detected, and the air flow status inside the intake manifold dependent on the intake manifold pressure is estimated, thereby permitting calculation of the throttle angle which achieves the target torque based on the said detected value and said estimated value.

The present invention is also characterized by the ability to detect the operating conditions of the engine dependent on the intake manifold pressure, and to estimate the air flow status inside the intake manifold pressure dependent on the air mass flow rate at the throttle and the air mass flow rate at the inlet port, thereby ensuring calculation of the throttle angle which achieves the target torque based on the said detected value and said estimated value.

The present invention is further characterized by the ability to detect the operating conditions of the engine dependent on either the air mass flow rate or intake manifold pressure and to calculate the target air mass flow rate at the inlet port from at least one of the target torques and the said detected value, thereby permitting calculation of the throttle angle, which achieves the above-calculated target air mass flow rate at the inlet port according to the said detected value and said estimated value.

Since it uses a status estimating model which ensures a high precision estimation of the air flow status inside the intake manifold, the present invention further provides a high-precision control of the air mass flow rate at the inlet port and ensures a high-precision maintenance of the engine-generated torque at the target value.

The foregoing and other objects, advantages, manner of operation and novel features of the present invention will be understood from the following detailed description when read in connection with the accompanying drawings.

DETAILED DESCRIPTION OF THE PREFERRED EMBODIMENTS

Figure 1:
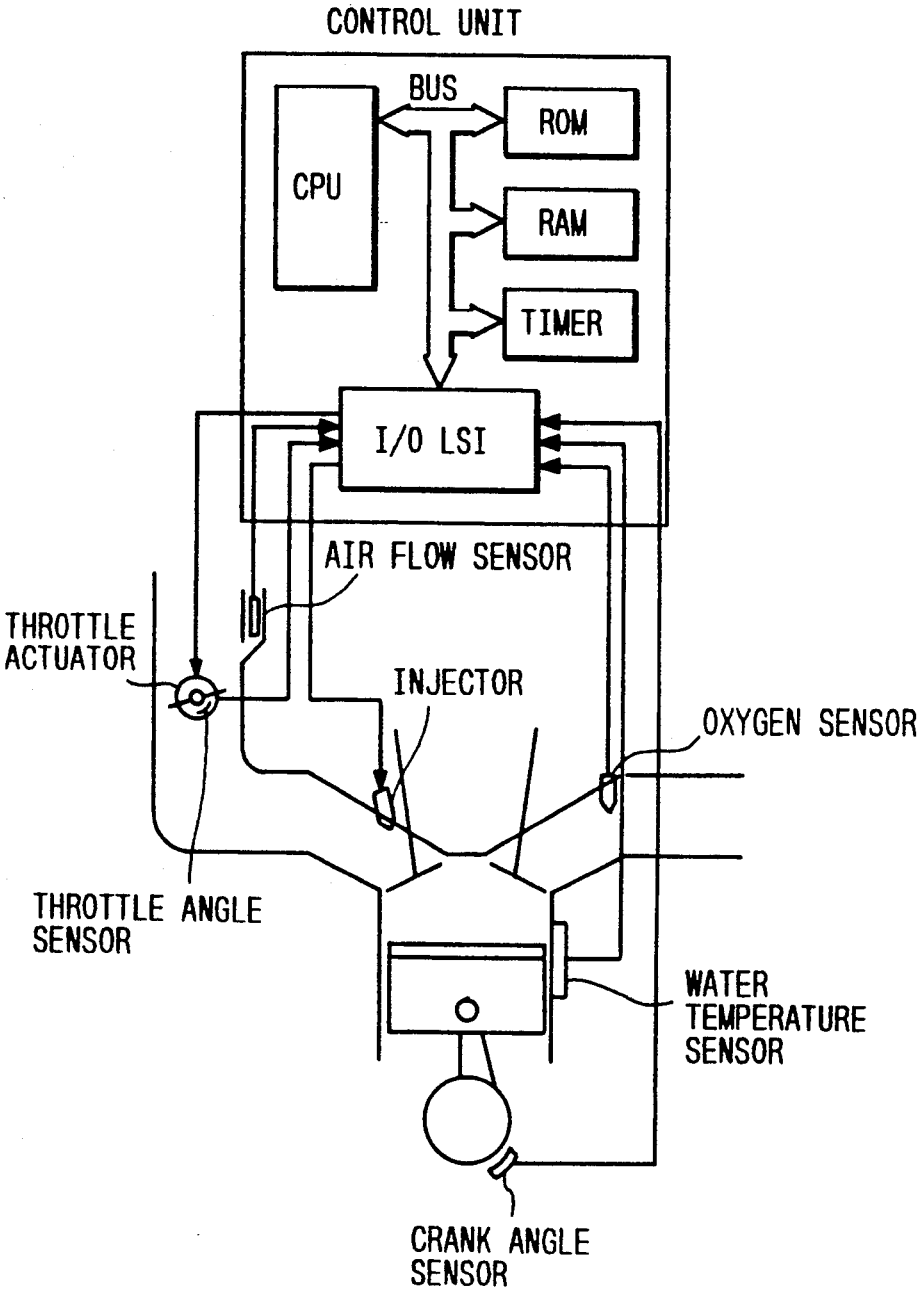
FIG. 1 is an overall block diagram representing the engine control system.

Embodiments of the present invention will be described with reference to the drawings. FIG. 1 is an overall block diagram representing the control system when the present invention is embodied by the use of a digital control unit. The control unit is provided with a CPU, ROM, RAM, timer, I/OLSI and buses to provide electrical connection of these units. Detection information issued from the throttle angle sensor, air flow sensor, water temperature sensor, crank angle sensor and oxygen sensor is sent to the RAM via the I/OLSI. The I/OLSI issues the fuel injection valve drive signal to the fuel injector and the drive signal to the throttle valve actuator.

Figure 2:
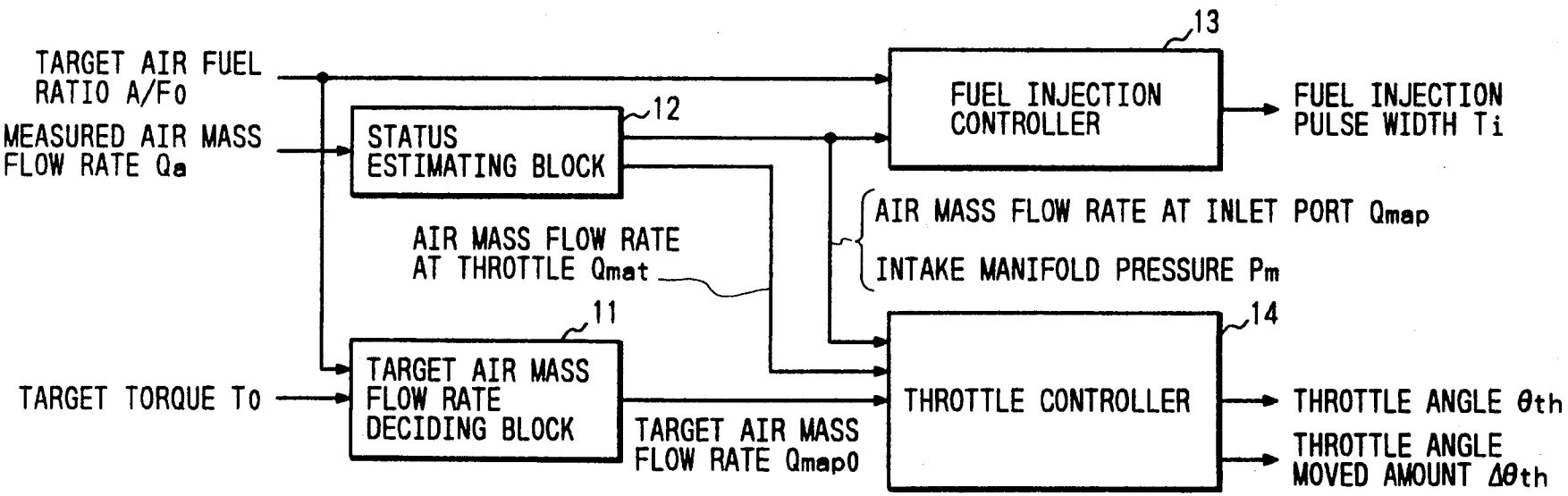
FIG. 2 is a block diagram representing simultaneous air fuel ratio and torque control.
Figure 3:
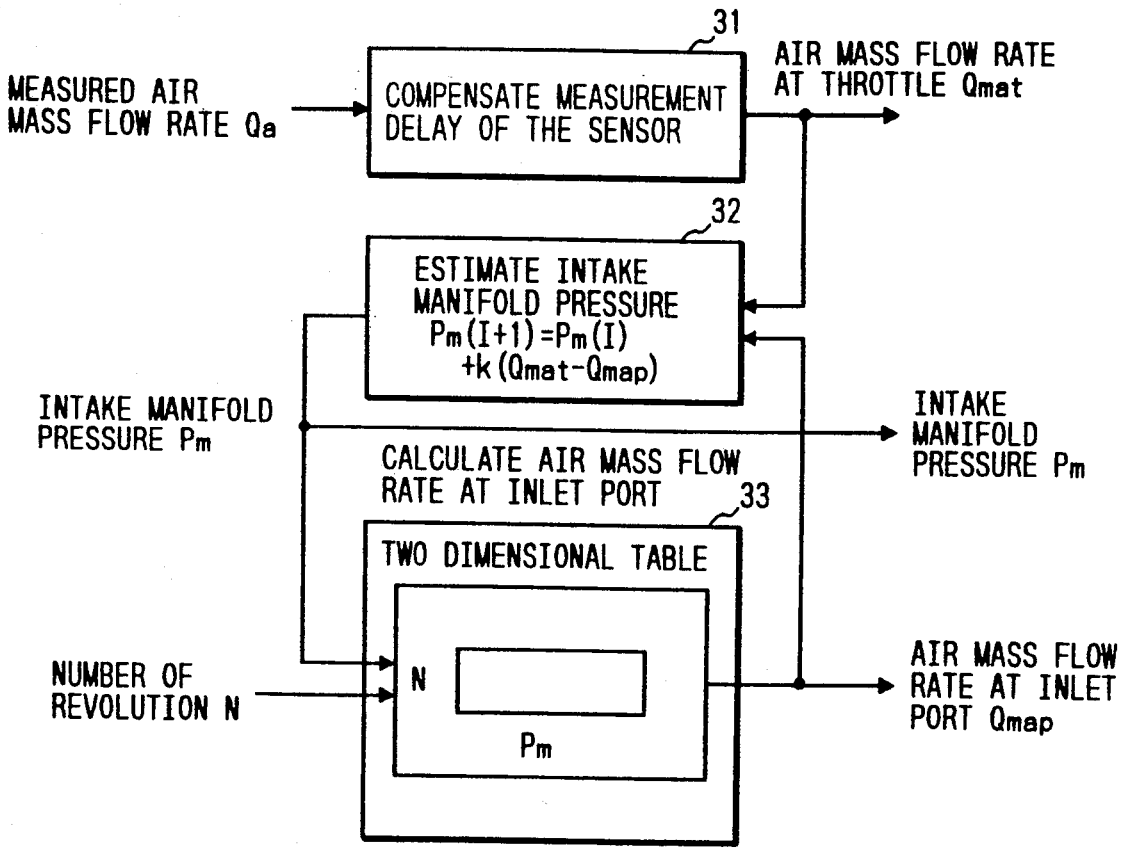
FIG. 3 is a block diagram representing the status estimating block.
Figure 4:
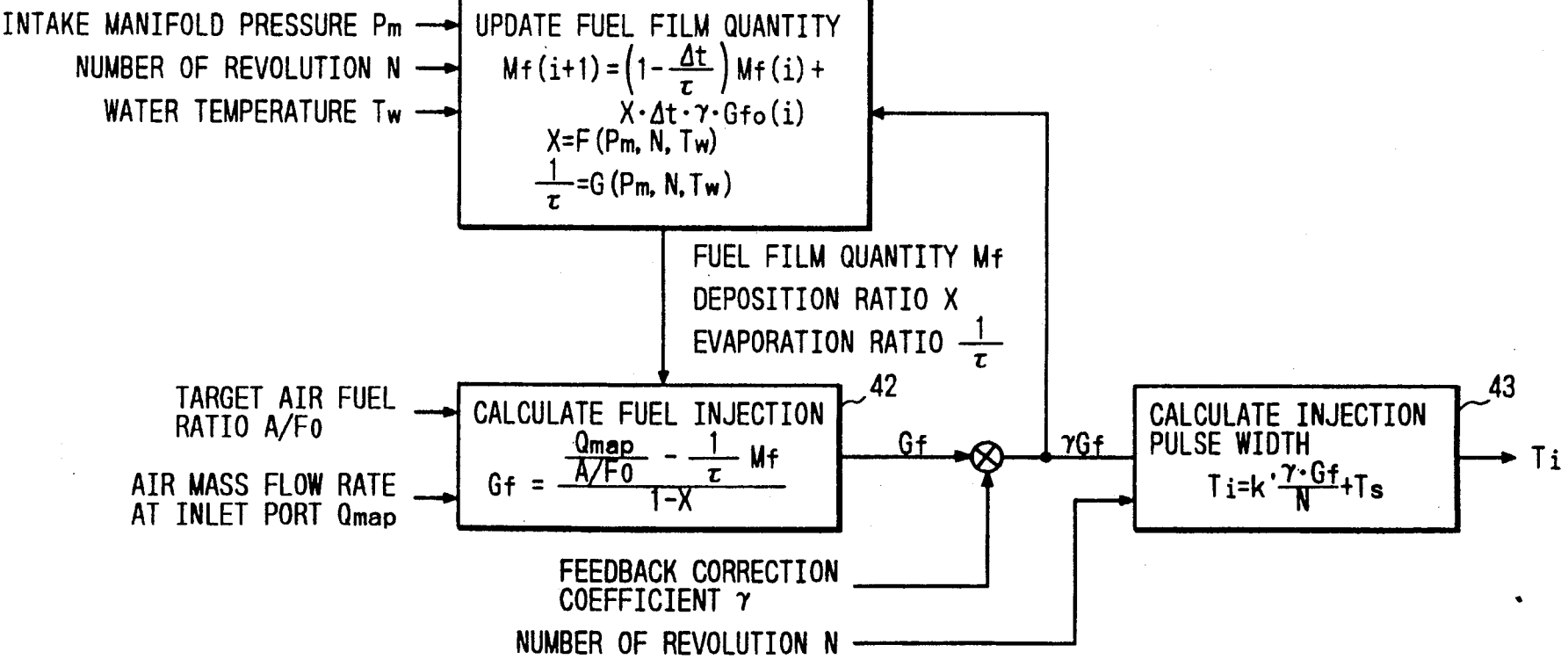
FIG. 4 is a block diagram representing the fuel injection control system.

With reference to FIGS. 2 to 4, description will be made firstly of the configuration and operation of the simultaneous torque and air fuel ratio control system, for which the program is stored in the ROM. As illustrated in FIG. 2, the control system comprises the status estimating block 12, target air mass flow rate deciding block 15, fuel injection control block 13 and throttle control block 14. The target air-fuel ratio, target torque and measured air mass flow rate are entered as major inputs, while the fuel injection pulse width, throttle angle and throttle angle movement amount are output.

Block 11 calculates the target air mass flow rate at inlet port $Q_{mapO}$ according to the following expression:

$$Q_{mapO} = \frac{N \cdot T_0}{K \cdot F_1(A/F_0) \cdot F_2(N) \cdot F_3(\theta_{adv})} \quad \text{(Expression 1)}$$

where, $T_0$: Target torque

N: Engine speed (number of revolutions)

$A/F_0$: Target air fuel ratio $\theta_{adv}$: Spark advance

K: Constant $F_1$, $F_2$, $F_3$, : Specified function

Expression 1 has been derived as follows:

The engine-generated torque T depends on the air mass $K \cdot Q_{map}/N$ taken into cylinder at inlet port, air fuel ratio A/F, engine speed (number of revolutions) N and spark advance $\theta_{adv}$. Thus, the following expression is assumed to calculate the torque from these variables:

$$T = K \frac{Q_{map}}{N} \cdot F_1(A/F) \cdot F_2(N) \cdot F_3(\theta_{adv}) \quad \text{(Expression 2)}$$

Of the said four expressions dependent on the engine-generated torque, the variables other than the argument for function $F_i$ (i=1, 2, 3) are fixed, and the variables of the arguments are changed. By measuring the engine-generated torque in this case, function $F_i$ can be determined from the measured value $S_i$ (x) according to the following expression:

$$F_i(x) = k_i \cdot S_i(x) \quad \text{(Expression 3)}$$

where,

X: Air fuel ratio or number of revolutions or spark advance $k_i$: Constant

Here constant $k_i$ is determined so that the torques obtained from Expressions 2 and 3 agree with the measured torque at a certain engine operating condition. Expression 1 is derived by solving the expression 2 which has determined the function, with respect to the air mass flow rate at the inlet port.

Next, the configuration and operation of the status estimating block 12 of FIG. 2 will be described with reference to FIG. 3. In block 31, measured air mass flow rate $Q_a$ is subjected to the response delay compensation for the air mass flow sensor. Namely, the air mass flow rate at throttle $Q_{mat}$ is calculated and updated from measured air mass flow rate $Q_a$ according to the following expression:

$$Q_{mat}(i) = \frac{\frac{2T_1 \cdot T_2}{\Delta t^2} - 1}{\frac{T_1 \cdot T_2}{\Delta t^2} + \frac{T_1 + T_2}{2\Delta t}} \cdot Q_{mat}(i-1) - \frac{\frac{T_1 \cdot T_2}{\Delta t^2} - \frac{T_1 + T_2}{2\Delta t}}{\frac{T_1 \cdot T_2}{\Delta t^2} + \frac{T_1 + T_2}{2\Delta t}} \cdot Q_{mat}(i-2) + \frac{\frac{T_3}{2\Delta t}}{\frac{T_1 \cdot T_2}{\Delta t^2} + \frac{T_1 + T_2}{2\Delta t}} \cdot Q_a(i) - \frac{\frac{T_3}{2\Delta t}}{\frac{T_1 \cdot T_2}{\Delta t^2} + \frac{T_1 + T_2}{2\Delta t}} \cdot Q_a(i-2) + \frac{1}{\frac{T_1 \cdot T_2}{\Delta t^2} + \frac{T_1 + T_2}{2\Delta t}} \quad \text{(Expression 4)}$$

where, $Q_a$: Measured air mass flow rate $Q_{mat}$: Air mass flow rate at throttle $T_1$,$T_2$,$T_3$: Positive constant Expression 4 is to be solved on the assumption that the air mass flow rate at the throttle has a relationship of the secondary delay as shown in Expression 5, with respect to the measured air mass flow rate:

$$\frac{Q_a(S)}{Q_{mat}(S)} = \frac{1 + ST_3}{(1 + ST_1)(1 + ST_2)} \quad \text{(Expression 5)}$$

In block 32, intake manifold pressure $P_m$ calculated from the air mass flow rate at throttle $Q_{mat}$ which is calculated in block 31, and air mass flow rate at inlet port $Q_{map}$ which is calculated by searching the table 33 according to the following expression:

$$P_m(i+1) = P_m(i) + \frac{R \cdot T_m}{V_m} \cdot \Delta t \cdot (Q_{mat} - Q_{map}) \quad \text{(Expression 6)}$$

where $Q_{mat}$: Air mass flow rate at throttle $Q_{map}$: Air mass flow rate at inlet port $P_m$: Intake manifold pressure $T_m$: Intake manifold air temperature (set to approx. 330K)

$V_m$: Intake manifold volume

R: Gas constant $\Delta t$: Updated cycle for intake manifold pressure i: Time (one time unit corresponding to $\Delta t$)

Block 33 calculates the air mass flow rate at inlet port $Q_{map}$ by searching the two dimensional table for the intake manifold pressure and engine speed, where the data on air mass flow rate taken in during engine operation in the stationary status are stored. Momentary responses for the air mass flow rate at the throttle, intake manifold pressure and air mass flow rate at the inlet port are obtained by repeating the processing of blocks in the sequence of 31, 32 and 33.

The following describes the configuration and operation of the fuel injection control system, with reference to FIG. 4. Block 41 calculates the deposition ratio X of the injected fuel onto the intake manifold and evaporation ratio ($1/\tau$) of deposited fuel according to Expressions 7 and 8.

$$X=F(P_m, N, T_w) \quad \text{(Expression 7)}$$

where, $P_m$: Intake manifold pressure
N: Engine speed
$T_w$: Water temperature
F: Function $$1/\tau = G(P_m, N, Tw) \quad \text{(Expression 8)}$$

where $P_m$: Intake manifold pressure
N: Engine speed
$T_w$: Water temperature
G: Function Functions F and G are determined through the specified experiments. These functions can be determined, for example, using the method described in the printouts No. 842049 delivered before the conference at the Society of Automobile Technology. Furthermore, the estimated fuel film quantity Mf is updated, using the said calculated parameters according to the following expression:

$$M_f(i+1) = \left(1 - \frac{\Delta t}{\tau}\right) \cdot M_f(i) + X \cdot \Delta t \cdot G_{fo} \quad \text{(Expression 9)}$$

where, $M_f$: Fuel film quantity
$G_{f0}$: Effective value of fuel injection
X: Deposition ratio
$1/\tau$: Evaporation ratio
$\Delta t$: Updated cycle for fuel film quantity
i: Time (one time unit corresponding to $\Delta t$)

Furthermore, block 42 calculates the fuel injection quantity using the value calculated in block 41 according to the following expression:

$$G_f = \frac{\frac{Q_{map}}{A/F} - \frac{1}{\tau} \cdot M_f}{1 - X} \quad \text{(Expression 10)}$$

$Q_{map}$: Air mass flow rate at inlet port
$A/F_0$: Target air fuel ratio
$M_f$: Fuel film quantity
X: Deposition ratio
$1/\tau$: Evaporation ratio Block 42 calculates the fuel injection pulse width Ti according to the following expression:

$$T_i = k \cdot \frac{\gamma \cdot G_f}{N} \cdot T_s \quad \text{(Expression 11)}$$

where $G_f$: Fuel injection quantity
N: Engine speed
$\gamma$: Feedback correction coefficient
$T_s$: Invalid injection time With reference to FIG. 5, the following describes the configuration and operation of the throttle control system which is characteristic of the present invention:

The said control system determines the throttle angle and the throttle angle moved amount, which achieve the target air mass flow rate, for which four expressions are used as basic expressions as shown below.

$$Q_{mat}=k' \cdot f(\theta_{th}, P_m) \quad \text{(Expression 12)}$$

where, $Q_{mat}$: Air mass flow rate at throttle
$\theta_{th}$: throttle angle
$P_m$: Intake manifold pressure
k': Variable to be corrected by a specified calculation
f: Specified function $$\frac{dP_m}{dt} = k'' \cdot f(Q_{mat} - Q_{map}) \quad \text{(Expression 13)}$$

where, $Q_{mat}$: Air mass flow rate at throttle
$Q_{map}$: Air mass flow rate at inlet port
$P_m$: Intake manifold pressure
t: Time
k'': Constant $$k'' = \frac{R \cdot T_m}{V_m} \quad \text{(Expression 14)}$$

where, $T_m$: Intake manifold air temperature (set to approx. 330K)
$V_m$: Intake manifold volume
R: Gas constant $$Q_{map}=g(P_m, N) \quad \text{(Expression 15)}$$

where $Q_{map}$: Air mass flow rate at inlet port
$P_m$: Intake manifold pressure
N: Engine speed
g: Specified function In Expression 12, function f is equivalent to the table where the air mass flow rate taken in during engine operation in the stationary status is stored to correspond to the throttle angle and intake manifold pressure. The value of function f can be obtained by searching the table. Expression 13 is derived from the fact that the pressure change per unit time is proportionate to the air mass accumulated in the intake manifold per unit time. In Expression 15, function g is equivalent to the table where the air mass flow rate taken in during engine operation in the stationary status is stored to correspond to the engine speed and intake manifold pressure. The value of function g can be obtained by searching the table.

Expression 12 is totally differentiated in the neighborhood of the throttle angle $\theta_{th}$ and intake manifold pressure $P_m$, and the following three expressions are obtained:

$$\Delta Q_{mat} = k' \cdot (k_{\Delta\theta th} + k_2 \Delta P_m) \quad \text{(Expression 16)}$$

$$k_1 = f_1(\theta_{th}, P_m) = \frac{\partial f(\Delta_{th}, P_m)}{\partial \theta_{th}} \quad \text{(Expression 17)}$$

$$k_2 = f_2(\theta_{th}, P_m) = \frac{\partial f(\theta_{th}, P_m)}{\partial P_m} \quad \text{(Expression 18)}$$

where, f1 and f2 are equivalent to the two dimensional table for the throttle angle and intake manifold pressure.

The following Expression is obtained by making Expression 13 discrete:

$$\frac{\Delta P_m}{\Delta t} = k'' \cdot \{Q_{mat} + \Delta Q_{mat} - (Q_{map} + \Delta Q_{map})\} \quad \text{(Expression 19)}$$

where $\Delta Q_{mat}$, $\Delta Q_{map}$ and $\Delta P_m$ are minute variations of the variables.

Then Expression 15 is totally differentiated in the neighborhood of the engine speed and intake manifold pressure $P_m$ and the following two expressions are obtained:

$$Q_{map} = k_3 \cdot P_m \quad \text{(Expression 20)}$$

$$k_3 = g_1(P_m, N) = \frac{\partial g(P_m, N)}{\partial P_m} \quad \text{(Expression 21)}$$

where g1 is equivalent to the two dimensional table for the intake manifold pressure and engine speed.

The $\Delta Q_{mat}$ and $\Delta P_m$ are eliminated in Expressions 16, 19 and 20 to obtain the relation of $\Delta\theta_{th}$ and $\Delta Q_{map}$ as follows:

$$\Delta\theta_{th} = \frac{1}{k' \cdot k'' \cdot k_1} \cdot \left\{ \frac{1}{k_3 \cdot \Delta t} + k'' \cdot \left(1 - \frac{k' \cdot k_2}{k_3}\right) \right\} \cdot \Delta Q_{map} - \frac{1}{k' \cdot k_1} \cdot (Q_{mat} - Q_{map}) \quad \text{(Expression 22)}$$

Using Expression 22, it is possible to obtain the throttle angle moved amount $\Delta\theta_{th}$ which changes the air mass flow rate at throttle inlet port $Q_{map}$ by $Q_{map}$. When the target air mass flow rate at inlet port $Q_{map}$ to achieve the target torque is $Q_{map0}$, the throttle angle moved amount $\Delta\theta_{th}$ to achieve the said target air mass flow rate can be obtained by calculating the $\Delta Q_{map}$ from the following Expression and substituting the result into Expression 22.

$$Q_{map} = Q_{map0} - Q_{map} \quad \text{(Expression 23)}$$

Figure 5:
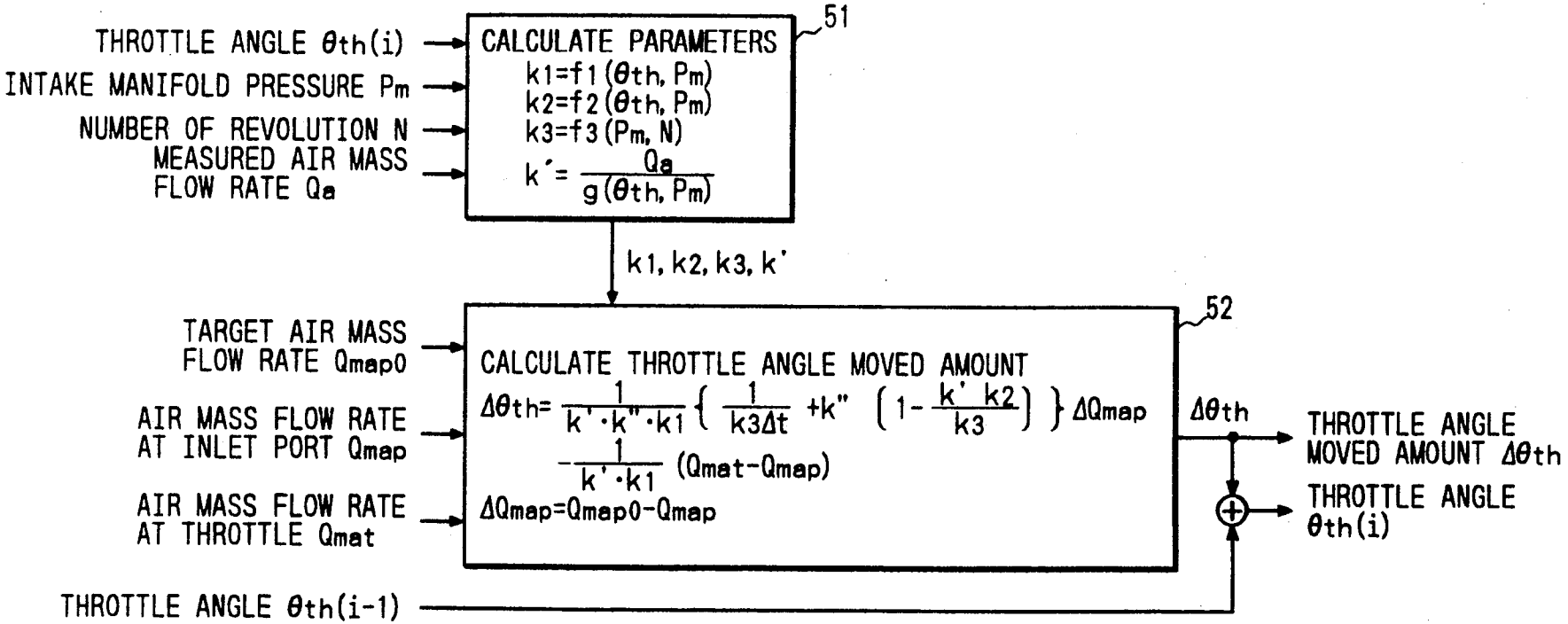
FIG. 5 is a block diagram representing the throttle control system.

FIG. 5 illustrates the configuration of the said throttle control system. Block 51 calculates the said various parameters. In block 52, throttle angle moved amount $\Delta\theta_{th}$ is calculated from the calculated parameters. Further, throttle angle moved amount $\Delta\theta_{th}$ is added to the throttle angle $\theta_{th}$ (i−1) one time unit before, thereby calculating the current throttle angle $\theta$(i). The above is the description of the configuration and operation of the throttle control system.

Figure 6:
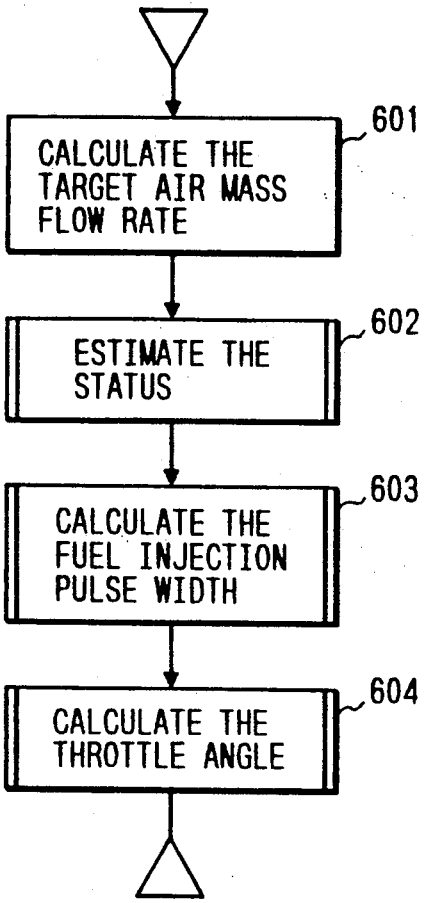
FIG. 6 is a flow chart representing the simultaneous air fuel ratio and torque control program.
Figure 7:
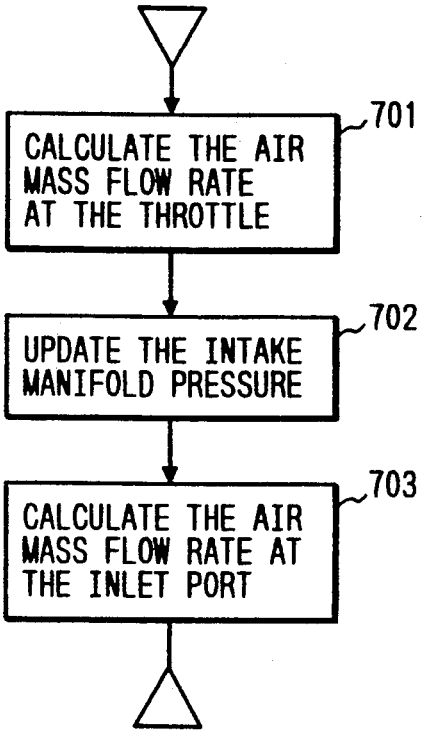
FIG. 7 is a flow chart representing the status estimating subroutine.
Figure 8:
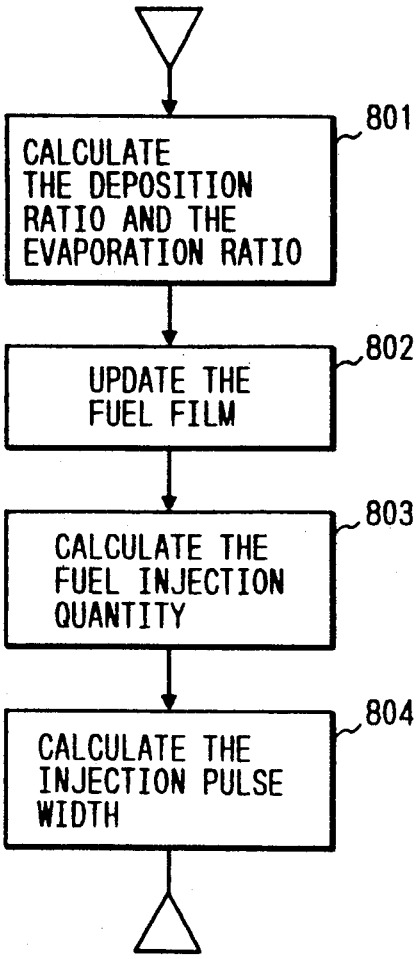
FIG. 8 is a flow chart representing the subroutine to calculate the fuel injection pulse width.
Figure 9:
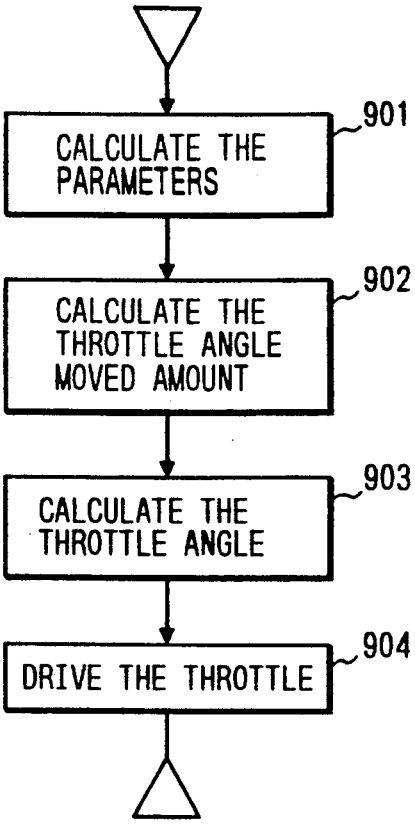
FIG. 9 is a flow chart representing the subroutine to calculate the throttle angle.
Figure 10:
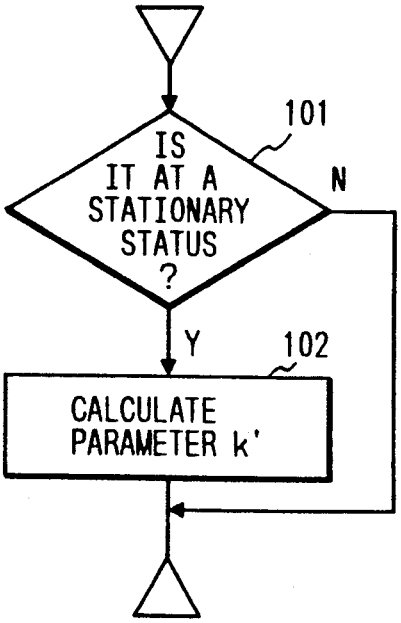
FIG. 10 is a flow chart representing the subroutine to calculate the parameter.

The following describes the operation of a program when the simultaneous torque and air fuel ratio control system is converted into the program in the ROM. FIGS. 6 to 10 show the program flow chart. FIG. 6 illustrates the main program, while FIGS. 7 to 9 illustrate the subroutine called in the main program. FIG. 10 shows a subprogram which calculates a certain variable in the main program. The programs shown in FIGS. 6 sand 10 are run at the specified cycle. First, the operation of the main program will be described with reference to FIGS. 6 to 9.

Step 601 in FIG. 6 calculates target air mass flow rate $Q_{map0}$ from the target torque $T_0$ according to Expression 1. Then step 602 calls the subroutine in FIG. 7 to estimate the air flow condition in the intake manifold. Step 701 in FIG. 7 calculates the air mass flow rate at throttle $Q_{mat}$ according to Expression 4. The step 702 updates the intake manifold pressure $P_m$ according to Expression 6. Step 703 then searches the table storing the data on the stationary air mass flow rate from the updated intake manifold pressure $P_m$ and engine speed N, and calculated the air mass flow rate at the inlet port. Processing of said subroutine has terminated to return the processing to the main program.

Step 603 in FIG. 6 calls the subroutine in FIG. 8 to calculate the fuel injection pulse width. Step 801 in FIG. 8 calculates deposition ratio X and evaporation ratio $1/\tau$ according to Expressions 7 and 8. At step 802, the fuel film quantity Mf is updated according to Expression 9. Then step 803 calculates fuel injection $G_f$ according to Expression 10. Finally, step 804 calculates fuel injection pulse width $T_i$ according to Expression 11. The processing of said subroutine is terminated to return processing to the main program.

Step 604 in FIG. 6 calls the subroutine in FIG. 9 to calculate the throttle angle moved amount and throttle angle. Step 901 in FIG. 9 calculates parameters other than k' in block 51 in FIG. 5. Then step 902 calculates the throttle angle moved amount $\Delta\theta_{th}$ according to Expressions 22 and 23. Step 903 then calculates current throttle angle $\theta_{th}$ (i) according to Expression 24.

$$\theta_{th}(i) = \theta_{th}(i-1) + \Delta\theta_{th} \quad \text{(Expression 24)}$$

where, i: Time (one time unit corresponding to the execution cycle of the said program)

Finally, step 904 sends to the throttle actuator the throttle angle actuating signal which moves the throttle angle by $\Delta\theta_{th}$. All processing of the main program has now terminated.

With reference to FIG. 10, the following describes the operation of the program which calculates parameter k' of block 51: First, step 101 checks if the following Expression has been satisfied or not, thereby checking if the engine is in the stationary operating status or not.

$$|\theta_{th}(i) - \theta_{th}(i-2)| < m_1 \quad \text{(Expression 25)}$$

$$|\theta_{th}(i-2) - \theta_{th}(i-4)| < m_1 \quad \text{(Expression 26)}$$

$$|M_f(i) - M_f(i-2)| < n_1 \quad \text{(Expression 27)}$$

$$|M_f(i-2) - M_f(i-4)| < n_1 \quad \text{(Expression 28)}$$

where $m_1$ and $n_1$ are positive constants, $\theta_{th}$: throttle angle $M_f$: Fuel film quantity i: Time (one time unit corresponding to 10 msec.)

If the system has determined that the engine is in the stationary operating status, it proceeds to the next processing. If not, the system terminates the processing. Step 102 calculates parameter k' according to the following Expression:

The processing has now terminated.

$$k' = \frac{Q_a}{f(\bar{\theta}_{th}, \bar{P}_m)} \quad \text{(Expression 29)}$$

where, $\bar{\theta}_{th}$: Current detected throttle angle $\bar{P}_m$: Current estimated intake manifold pressure $Q_a$: Current measured air mass flow rate The above is the description of the configuration and control program when implementing the air fuel torque control system by means of the digital control unit shown in FIG. 2.

Figure 11:
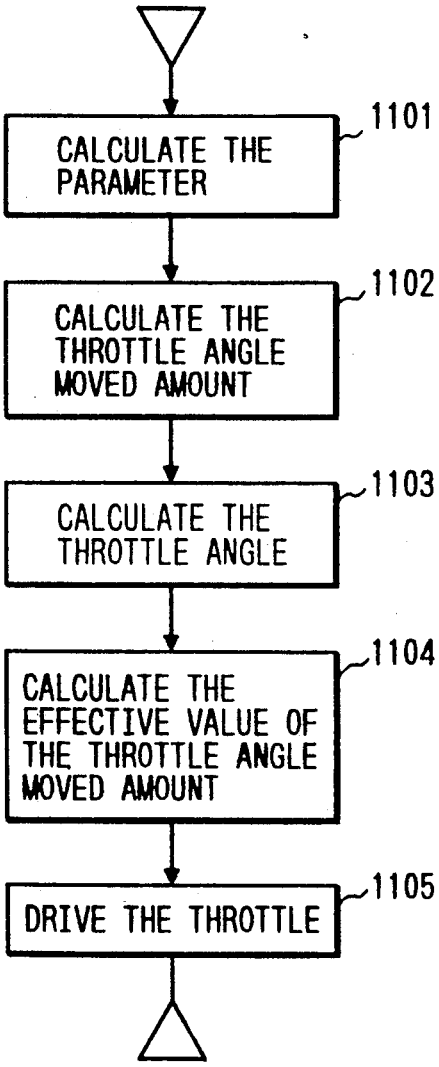
FIG. 11 is a flow chart representing the subroutine to calculate the throttle angle when using the torque sensor.

Using the said embodiment, the above has described the method of providing high-precision control of the engine-generated torque without using the torque sensor. Use of the torque sensor further increases the control precision. In this case, a different program must be used for the subroutine to calculate the throttle angle in the control program. FIG. 11 illustrates the said program. Processing in steps 1101 and 1102 is the same as that in steps 901 and 902. Step 1103 calculates the throttle angle $\theta_{th}$ (i) according to the following Expression:

$$\theta_{th}(i) = m(i) \cdot \{\theta_{th}(i-1) + \Delta\theta_{th}\} \quad \text{(Expression 30)}$$

where, m(i): correction coefficient calculated according to the torque sensor output i: time Correction coefficient m(i) is used to correct the throttle angle so that the torque will reach the target, when the actual torque is deviated from the target value; thereby ensuring highprecision control. Said correction coefficient is calculated by another program to be explained later.

Step 1104 calculates the effective value $\Delta\theta_{th}'$ of the throttle angle moved amount according to the following Expression:

$$\Delta\theta_{th}' = \theta_{th}(i) - \Delta\theta_{th}(i-1) \quad \text{(Expression 31)}$$

Finally, step 1105 sends to the throttle actuator the signal which actuates the throttle by the said calculated value $\Delta\theta_{th}'$. Processing of the said subroutine has now terminated.

Figure 12:
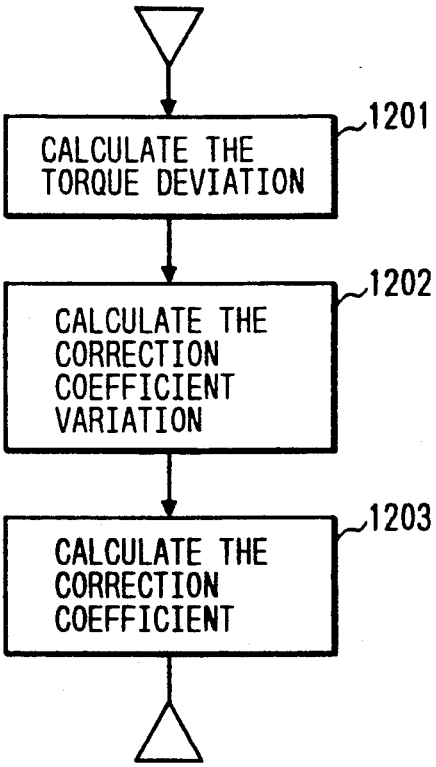
FIG. 12 is a flow chart representing the subroutine to calculate the throttle angle correction coefficient.

With reference to FIG. 12, the following describes the operation of the program to calculate the correction coefficient m(i):

First, step 1201 calculates the torque deviation e(i) according to the following Expression:

$$e(i) = T(i) - T_0(i) \quad \text{(Expression 32)}$$

where

T: Detected torque $T_0$: Target torque i: Time (one time unit corresponding to the execution cycle of the said program)

Step 1202 calculates the correction coefficient variation Δm (i) according to the following Expression. This means that the correction coefficient is calculated by PID control.

$$\Delta m(i) = K_p\{e(i) - e(i-1)\} + K_1 \cdot \frac{e(i-1) + e(i)}{2} + K_D \cdot \{e(i) - 2e(i-1) + e(i-2)\} \quad \text{(Expression 33)}$$

where, $K_p$: Proportional gain $K_i$: Integral gain $K_d$: Differential gain

Step 1203 calculates the correction coefficient m (i) according to the following Expression. Processing has now terminated.

$$m(i) = m(i-1) + \Delta m(i) \quad \text{(Expression 34)}$$

The above is the description of the modified portion of the control program when the torque sensor is used.

As described above, the present invention provides a means for high-precision determination of the throttle angle such that the air mass flow rate at the inlet port will reach the target, according to the model representing the air mass flow in the intake manifold. This allows the engine-generated torque to be maintained at the target with high precision.

The above description is concerned with the simultaneous torque/air fuel ratio control method in the L Jetronic System which directly detects the air mass flow rate.

Figure 13:
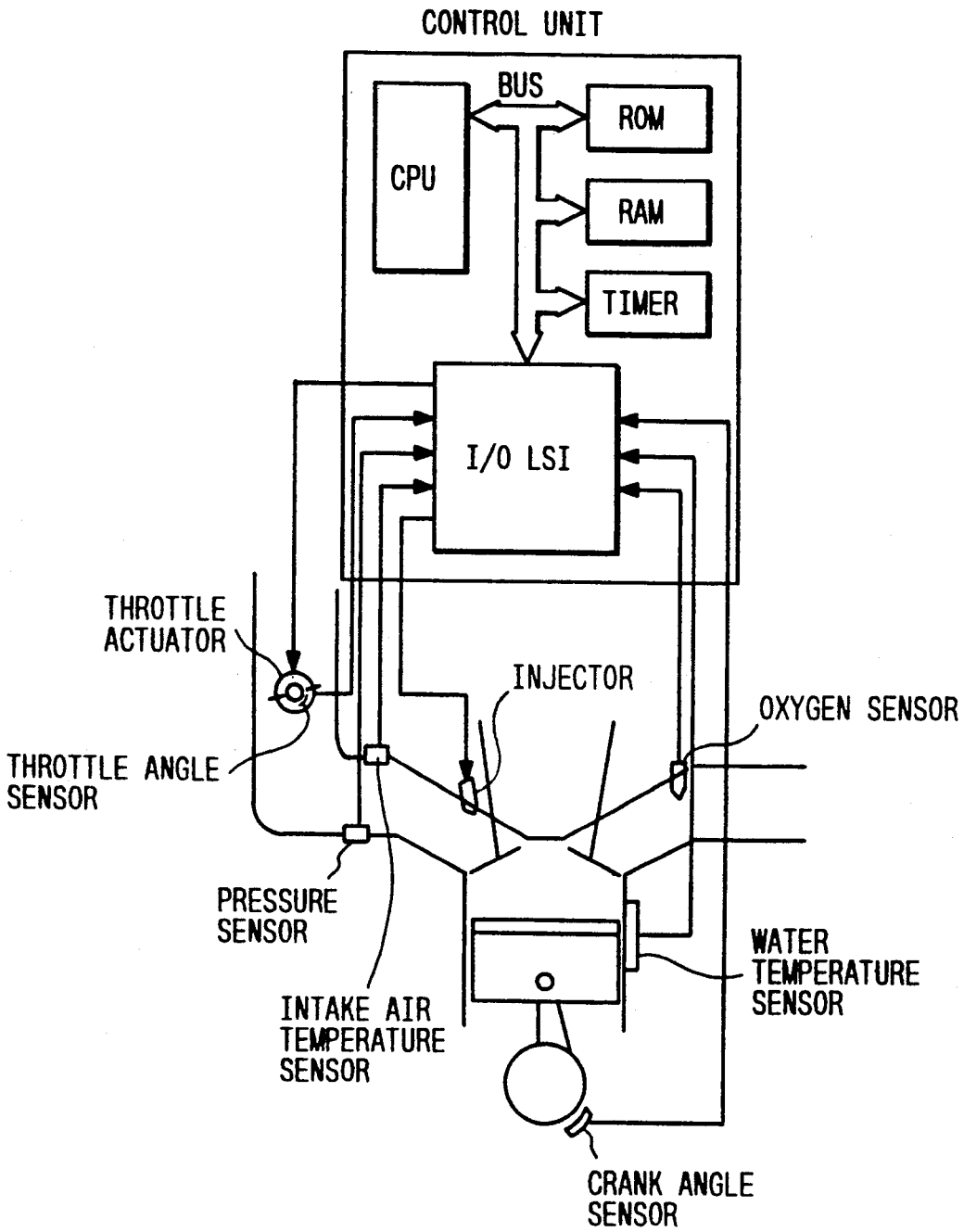
FIG. 13 is an overall block diagram of an engine control system according to the present invention, having a pressure sensor.

The following describes the simultaneous torque/air fuel ratio control method in the D Jetronic System which detects the air mass flow rate indirectly from the measured intake manifold pressure. FIG. 13 is a block diagram representing the control system of said method. A pressure sensor and intake air temperature sensor are provided in place of the air flow sensor, and their signals are sent to the RAM via the I/OLSI. Other configuration is the same as that of the L Jetronic System.

Figure 14:
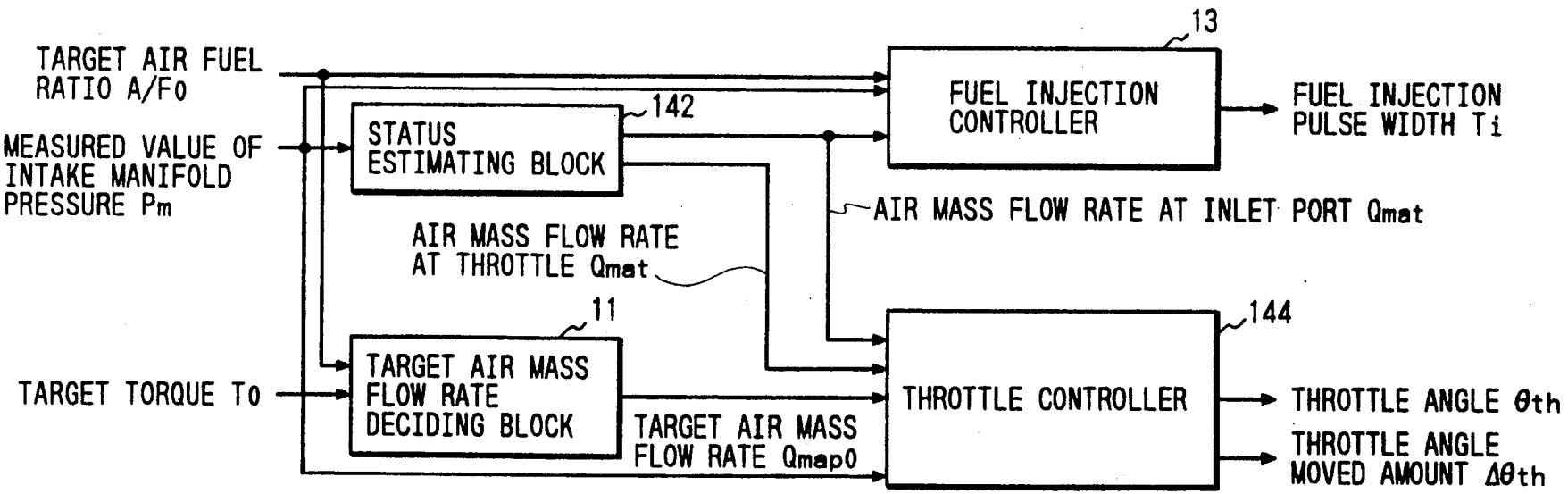
FIG. 14 is a block diagram of simultaneously controlling air-fuel ratio and torque, in said engine control system having a pressure sensor.
Figure 15:
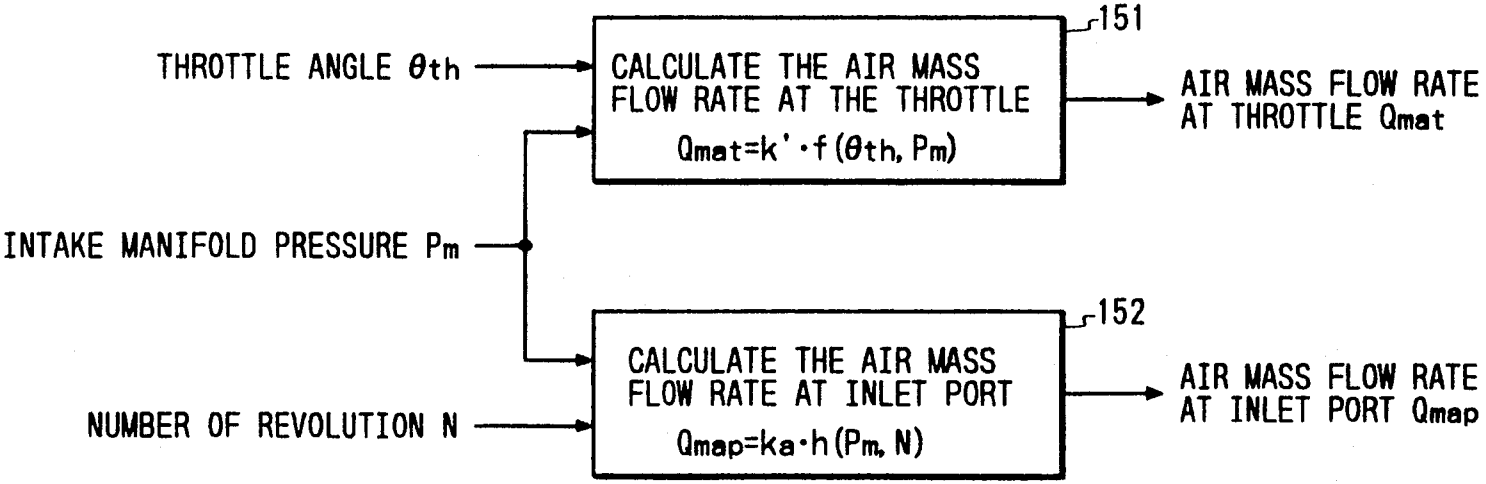
FIG. 15 is a block diagram of the status estimating block in FIG. 14.

The following describes the configuration of the simultaneous torque/air fuel ratio control system with reference to FIG. 14. The target air fuel ratio, target torque and intake manifold pressure are input as major input signals, thereby calculating the fuel injection pulse, throttle angle and throttle angle moved amount. The difference with the L Jetronic System is found in processing of the status estimating block and throttle control system. FIG. 15 is a concrete block diagram representing the status estimating block. Block 151 calculates the air mass flow rate at the throttle from the throttle angle and detected intake manifold pressure according to the Expression 12. Block 152 calculates the air mass flow rate at the inlet port from the intake manifold pressure and the detected engine speed according to the following Expression:

$$\Delta Q_{map} = k_a \cdot h(P_m, N) \quad \text{(Expression 35)}$$

where, h: two dimensional table $k_a$: correction coefficient calculated according to the output of the intake air temperature sensor, etc.

The above is the description of processing of the status estimating block.

Figure 16:
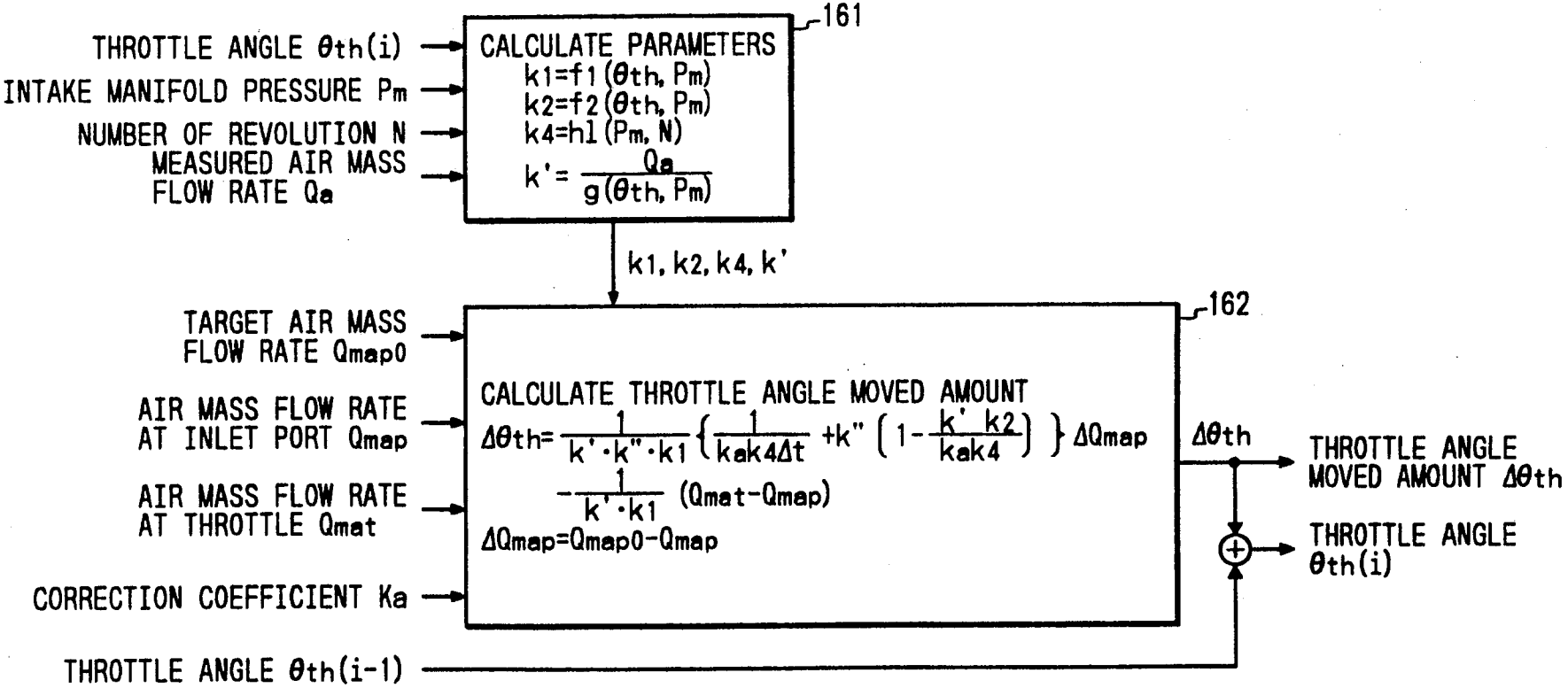
FIG. 16 is a block diagram of the throttle controller in FIG. 14.

The following describes processing of the throttle control system with reference to FIG. 16. The calculation formula of the throttle angle moved amount is derived as shown below:

The following Expression is obtained by total differentiation of the Expression 35 in the neighborhood of the engine speed and intake manifold pressure.

$$\Delta Q_{map} = k_a k_4 \cdot \Delta P_m \quad \text{(Expression 36)}$$

$$K_4 = h_1(P_m, N) = \frac{\partial h(P_m, N)}{\partial P_m} \quad \text{(Expression 37)}$$

Eliminating the $\Delta Q_{mat}$ and $\Delta P_m$ from Expressions 16, 19 and 36, the relation between the $\Delta\theta_{th}$ and $\Delta Q_{map}$ is derived as follows:

$$\Delta\theta_{th} = \frac{1}{k' \cdot k'' \cdot k_1}\left\{\frac{1}{k_a k_4 t} + k''\left(1 - \frac{k' k_2}{k_a k_4}\right)\right\}\Delta Q_{map} - \frac{1}{k' \cdot k_1}(Q_{mat} - Q_{map}) \quad \text{(Expression 38)}$$

Block 161 in FIG. 16 calculates various coefficients, thereby providing calculation of the throttle angle moved amount from Expression 38 according to said calculation result in Block 162.

The above is the description of the overall block diagram of the control system in FIG. 14. The flow chart of the program to implement the processing of the configuration in FIG. 14 is almost equivalent to that of the L Jetronic system (from FIG. 6 to FIG. 12). The difference is that FIG. 7 has no processing for estimation of the intake manifold pressure. The concrete processing is the same as that for the L Jetronic system.

What is claimed is:

1. An engine control method, comprising the steps of:

detecting operating conditions of the engine, including air mass flow rate;

calculating a value of target torque based upon the detected operating conditions of the engine;

estimating a value of actual air flow status inside the intake manifold using an air flow model based upon at least one of said detected operating conditions of the engine related to air flow;

calculating a throttle angle which achieves the calculated value of target torque, based on the calculated value of target torque and said estimated value of actual air flow status; and controlling the engine throttle based upon the calculated throttle angle.

2. An engine control method according to claim 1, wherein said actual air flow status comprises at least one of air mass flow rate at the throttle, air mass flow rate at the inlet port and intake manifold pressure.

3. An engine control method according to claim 2, further comprising the steps of:

calculating a target air mass flow rate at the inlet port by use of the calculated target torque, on the basis of a formula defined in advance for the target torque and the air mass flow rate at the inlet port; and calculating a throttle angle which achieves the target torque from the said calculated target air mass flow rate at the inlet port and said estimated air flow status.

4. An engine control method according to claim 3, further comprising the steps of:

linearizing around the current operating conditions of the engine an air flow model representing an air flow in the intake manifold; and calculating the throttle angle which achieves the target torque by use of the linearized model, the estimated value of actual air flow status, and the target air mass flow rate in the inlet port.

5. An engine control method according to claim 2, further comprising the steps of:

detecting the engine torque; and calculating an effective throttle angle by correcting the calculated throttle angle by a correction coefficient which is obtained from a deviation between the detected torque and said target torque.

6. An engine control method according to claim 1, further comprising:

a step of determining a fuel injection which achieves a target air fuel ratio according to a dynamic model representing a fuel transmission characteristics inside said intake manifold.

7. An engine control method according to claim 2, further comprising:

a step of calculating said throttle angle, using a dynamic model which represents an air transmission characteristic inside the intake manifold, linearized in the neighborhood of the current engine operating conditions.

8. An engine control method according to claim 1, further comprising:

a step of determining a fuel injection which achieves a target air fuel ratio according to a dynamic model representing a fuel transmission characteristics inside said intake manifold.

9. An engine control method according to claim 1, further comprising:

a step of calculating said throttle angle, using a dynamic model which represents an air transmission characteristic inside and intake manifold, linearized in the neighborhood of the current engine operating conditions.

10. An engine control method, comprising the steps of:

detecting operating conditions of the engine including intake manifold pressure;

calculating a value of target torque based upon the detected operating conditions of the engine;

estimating a value of actual air flow status inside the intake manifold using an air flow model based at least upon one of said detected operating conditions of the engine related to air flow;

calculating a throttle angle which achieves the target torque, based on detected operating conditions and said estimated value of actual air flow status; and controlling the engine throttle based upon the calculated throttle angle.

11. An engine control method according to claim 10, wherein said actual air flow status comprises at least air mass flow rate at the throttle and air mass flow rate at the inlet port.

12. An engine control method according to claim 11, further comprising:

a step of calculating a target air mass flow rate at the inlet port by use of the calculated target torque, on the basis of a formula defined in advance for the target torque and the air mass flow rate at the inlet port; and a step of calculating the throttle angle which achieves the target torque from said calculated target air mass flow rate at the inlet port and said estimated actual air flow status.

13. An engine control method according to claim 11, further comprising:

a step of linearizing around the current operating conditions of the engine, an air flow model representing an air flow in the intake manifold; and a step of calculating the throttle angle which achieves the target torque by use of a linearized model, the estimated actual air flow status, and the target air mass flow rate at the inlet port.

14. An engine control method according to claim 11, further comprising:

a step of detecting the engine torque; and a step of calculating the effective throttle angle by correcting the calculated throttle angle by a correction coefficient which is obtained from the deviation between said detected torque and the target torque.

15. An engine control method according to claim 10, further comprising:

a step of determining a fuel injection which achieves a target air fuel ratio according to a dynamic model representing a fuel transmission characteristics inside said intake manifold.

16. An engine control method according to claim 10, further comprising:

a step calculating said throttle angle, using a dynamic model which represents an air transmission characteristic inside the intake manifold, linearized in the neighborhood of the current engine operating conditions.

17. An engine control method according to claim 10, further comprising:

a step of detecting the engine torque; and a step of calculating an effective throttle angle by multiplying the calculated throttle angle by a correction coefficient which is obtained from deviation between the detected torque and the target torque.

18. An engine control method, comprising the steps of:

detecting operating conditions of the engine including intake manifold pressure;

calculating a value of target torque based upon detected operating conditions of the engine;

calculating a target air mass flow rate at the inlet port from the target torque;

calculating a throttle angle which achieves the target torque, based on the intake manifold pressure detected in the detecting step and said target air mass flow rate at the inlet port; and controlling the engine throttle based upon the calculated throttle angle.

19. An engine control method according to claim 18, further comprising the steps of:

estimating a value of actual air flow status inside the intake manifold using an air flow model based at least on a detected operating condition of the engine related to air flow; and calculating a throttle angle which achieves the target torque from detected operating conditions and the estimated value of actual air flow status and said calculated target air mass flow rate at the inlet port.

20. An engine control method according to claim 18, further comprising the steps of:

linearizing around the current operating conditions of the engine an air flow model representing an air flow in the intake manifold; and calculating a throttle angle which achieves the target torque by use of the linearized model, the estimated value of actual air flow status and the target air mass flow rate in the inlet port.

21. An engine control method according to claim 18, further comprising:

a step of determining a fuel injection which achieves a target air fuel ratio according to a dynamic model representing a fuel transmission characteristics inside the intake manifold.

22. An engine control method according to claim 18, further comprising:

a step of obtaining by experiment a relation of correspondence between the engine conditions including the target air mass flow rate at the inlet port and the engine-generated torque; and a step of calculating the target air mass flow rate at the inlet port from the target torque using the relation.

23. An engine control method according to claim 18, further comprising:

a step of calculating the said throttle angle, using the dynamic model which represents the fuel transmission characteristics inside the said intake manifold, linearized in the neighborhood of the current engine operating conditions.

24. An engine control system comprising:

means for detecting operating conditions of the engine, including a condition related to air flow;

means for calculating a value of target torque based upon detected operating conditions of the engine;

means for estimating a value of actual air flow status inside the intake manifold using an air flow model based at least on one of the detected operating conditions of the engine related to air flow;

means for calculating a throttle angle which achieves the calculated value of target torque, based at least on said estimated value of actual air flow status; and means for controlling the engine throttle based upon the calculated throttle angle.

25. An engine control system comprising:

means for detecting operating conditions of the engine, including air mass flow rate;

means for calculating a value of target torque based upon detected operating conditions of the engine;

means for estimating a value of actual air flow status inside the intake manifold using an air flow model based at least upon one of said detected operating conditions of the engine related to air flow, said actual air flow status being different from said detected air mass flow rate;

means for calculating a throttle angle which achieves the calculated value of target torque, based at least on said estimated value of actual air flow status; and means for controlling the engine throttle based upon the calculated throttle angle.

26. An engine control system comprising:

means for detecting operating conditions of the engine, including intake manifold pressure;

means for calculating a value of target torque based upon detected operating conditions of the engine;

means for estimating an actual air flow status inside the intake manifold using an air flow model based at least upon one of said detected operating conditions of the engine related to air flow, said actual air flow status being different from said detected intake manifold pressure;

means for calculating a throttle angle which achieves said target torque from the detected operating conditions and the estimated value of actual air flow status; and means for controlling the engine throttle based upon the calculated throttle angle.

27. An engine control system comprising:

means for detecting operating conditions of the engine, including intake manifold pressure;

means for calculating a value of target torque based upon detected operating conditions of the engine;

means for calculating a target air mass flow rate at the inlet port from the target torque;

means for calculating a throttle angle which achieves the target torque, based on the detected intake manifold pressure and said target air mass flow rate at the inlet port; and means for controlling the engine throttle based upon the calculated throttle angle.

28. An engine control method comprising:

a step of detecting operating conditions of the engine, including a condition related to air flow;

a step of calculating a target torque, based upon the detected operating conditions of the engine;

a step of estimating a value of actual air flow status inside the intake manifold, through an air flow model using at least one of the detected operating conditions of the engine in connection with an air flow;

a step of calculating a throttle angle which achieves the calculated target torque, based on the calculated target torque and said estimated value of actual air flow status; and a step of controlling the throttle based upon the calculated throttle angle.

* * * * *